US005331334A

United States Patent [19]

Murayama

[11] Patent Number: 5,331,334

[45] Date of Patent: Jul. 19, 1994

[54] VACUUM FLUORESCENT DISPLAY DEVICE

[75] Inventor: Yoichi Murayama, Tokyo, Japan

[73] Assignee: NEC Corporation, Tokyo, Japan

[21] Appl. No.: 998,776

[22] Filed: Dec. 29, 1992

Related U.S. Application Data

[63] Continuation of Ser. No. 611,829, Nov. 13, 1990, abandoned.

[30] Foreign Application Priority Data

Nov. 15, 1989 [JP] Japan ..... 1-133230[U]

[51] Int. Cl.[5] ..... G09G 3/20

[52] U.S. Cl. ..... 345/47; 313/496

[58] Field of Search ..... 340/756, 761, 766, 789, 340/758; 313/496, 497, 51; 257/692, 693, 694, 695, 696, 697; 345/47, 30, 33, 75, 74, 205

[56] References Cited

U.S. PATENT DOCUMENTS 4,710,765 12/1987 Ohkoshi et al. ..... 340/781

4,989,066 1/1991 Sumi ..... 357/70

FOREIGN PATENT DOCUMENTS 1143246 6/1989 Japan .

*Primary Examiner*—Ulysses Weldon
*Assistant Examiner*—Doon Chow
*Attorney, Agent, or Firm*—Leydig Voit & Mayer

[57] ABSTRACT

A chip-in-glass type vacuum fluorescent display device includes an integrated circuit chip for driving a display unit in a vacuum glass envelope. The integrated circuit chip is connected to plural number of external terminals to be supplied with an electric power from an external power supply, so that resistances of the external terminals themselves, and those of the connecting points of the external terminals and conductor patterns which connect the terminals to the integrated circuit chip. As a result, the potential change at pads of the integrated circuit chip, which causes unstableness in operation of the integrated circuit and changes of characteristics thereof, is decreased.

8 Claims, 4 Drawing Sheets

VACUUM FLUORESCENT DISPLAY DEVICE

This application is a continuation of application Ser. No. 07/611,829, filed Nov. 13, 1990, now abandoned.

FIELD OF THE INVENTION

This invention relates to a vacuum fluorescent display (VFD) device, and more particularly to, a chip-in-glass (CIG) type VFD device which includes an integrated circuit chip for driving a display unit in a vacuum glass envelope.

BACKGROUND OF THE INVENTION

A conventional chip-in-glass type VFD device includes an integrated circuit chip for driving a display unit in a vacuum glass envelope thereof. The integrated circuit chip is connected to external terminals by conductor patterns to be supplied with an electric power from external power supply.

According to the conventional VFD device, however, there is a disadvantage in that potential change, which is caused by resistances of the external terminals themselves and connecting points of the external terminals and the conductor patterns, occurs at pads of the integrated circuit chip. When the integrated circuit chip has two inputs for power supplying, one of which is for low potential power supply (for instance, ground level) and other is for high potential power supply (for instance, $+V_C$), potential of the pad for low potential power supply becomes higher than that of the external terminal for low potential power supply. On the other hand, the high potential power supply becomes lower than that of the external terminal for high potential power supply. That is, the potentials of the ground level and $+V_C$ are changed to be $-V_D$ and $V_C-V_D$, respectively, where $V_D$ is the potential change. As a result, the integrated circuit chip may not operate stably or may not produce expected characteristics.

SUMMARY OF THE INVENTION

Accordingly, it is an object of the invention to provide a vacuum fluorescent display device in which an integrated circuit chip for driving the device operates stably and produces expected characteristics.

According to the invention, a vacuum fluorescent display device includes a display unit for displaying predetermined patterns. The display unit is mounted on a substrate and including anodes coated with fluorescent material, grid electrodes disposed above the anodes with a predetermined spacing therefrom, and cathode wires stretched above the grid electrodes with a predetermined spacing therefrom. A driving circuit is included for driving the display unit. The driving circuit is an integrated circuit mounted on the substrate. An external terminal supplies external electric power to the driving circuit. The external terminal is connected to the driving circuit by a conductive pattern disposed on the substrate. The external terminal includes parallel terminals jointly connected to the conductive pattern. The parallel terminals are bridged by a connecting member and are connected to the integrated circuit by no more than one conductor.

BRIEF DESCRIPTION OF THE DRAWINGS

The invention will be explained in more detail in conjunction with appended drawings, wherein.

DESCRIPTION OF THE PREFERRED EMBODIMENTS

Before describing a semiconductor memory device according to the invention, the conventional vacuum fluorescent display (VFD) device briefly described before will be explained in conjunction with FIGS. 1 and 2.

Figure 1:
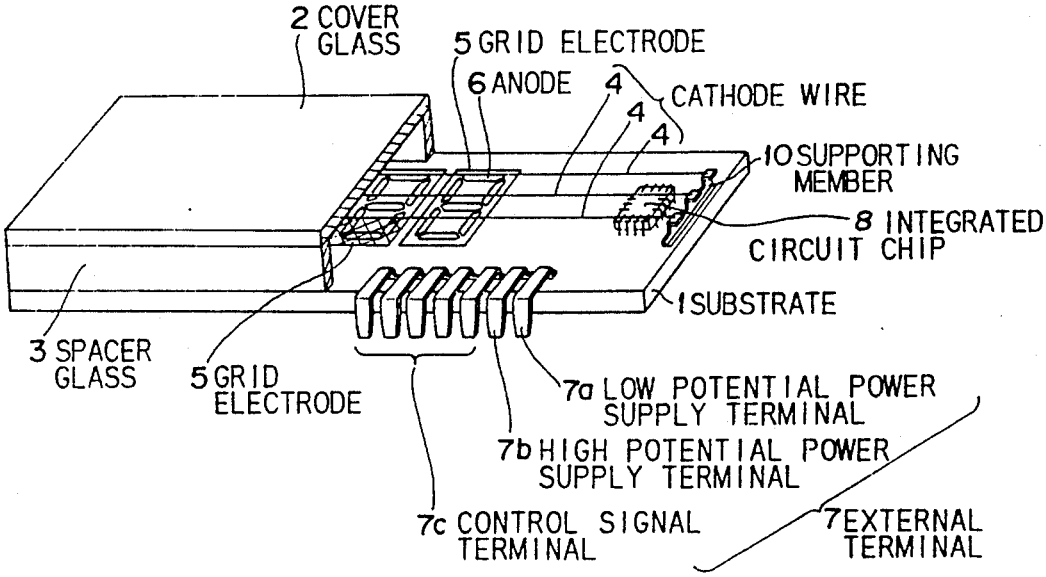
FIG. 1 PRIOR ART
FIG. 1 is a partially cutaway view in perspective illustrating the conventional vacuum fluorescent display device.
Figure 2:
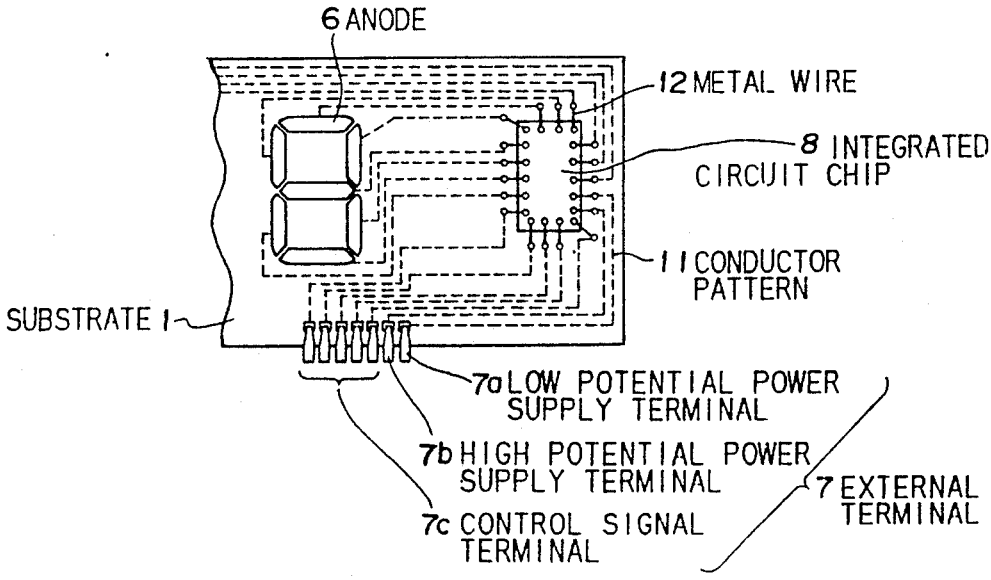
FIG. 2 PRIOR ART
FIG. 2 is a segmental view illustrating the conventional vacuum fluorescent display device.

FIGS. 1 and 2 show the conventional VFD device.

The VFD device comprises a substrate 1, on which a display unit for displaying predetermined patterns and an integrated circuit chip 8 for driving the display unit are mounted. The display unit comprises anodes 6 coated with fluorescent material, net-shaped grid electrodes 5 disposed at positions which are above the anodes 6 with a proper spacing therebetween, and cathode wires 4 stretched above the grid electrodes 5 at a proper spacing. The end of the cathode wires 4 are welded on supporting members 10. The integrated circuit chip 8 is connected at connecting electrodes (pads) thereof with metal wires 12, by which the integrated circuit chip 8 is supplied with an electric power or signals from external circuits outside the VFD device, or by which the integrated circuit chip 8 supplies the display unit with driving signals. External terminals 7 including low and high potential terminals 7*a* and 7*b*, and control signal terminals 7*c* are disposed on the edge of the substrate 1, and connected through the metal wires 12 and conductor patterns 11 disposed on the substrate 1 to the pads of the integrated circuit chip 8. The conductor patterns 11 also connect the pads of the integrated circuit chip 8 to the anodes 6 to supply the anodes 6 with driving signals from the integrated circuit chip 8. A cover glass 2 covers the above described elements on the substrate 1 with spacer glasses 3, wherein the glasses 2 and 3, and the substrate 1 are sealed with low melting point glass, so that a vacuum envelope of the VFD device is composed.

In operation, a voltage is applied to the cathode wires 4 to be heated. On the other hand, a predetermined voltage is applied to the grid electrodes 5 selectively by the integrated circuit 8. When the potential of the grid electrodes 5 becomes positive relative to that of the cathode wires 4, thermoelectrons are emitted from the cathode wires 4 toward the grid electrodes 5, and pass through the grid electrodes 5 to collide with the anodes 6 which are covered with fluorescent material, so that the fluorescence occurs on the surface of the anodes 6 to display a predetermined pattern according to the driving pattern of the grid electrodes 5.

Figure 3:
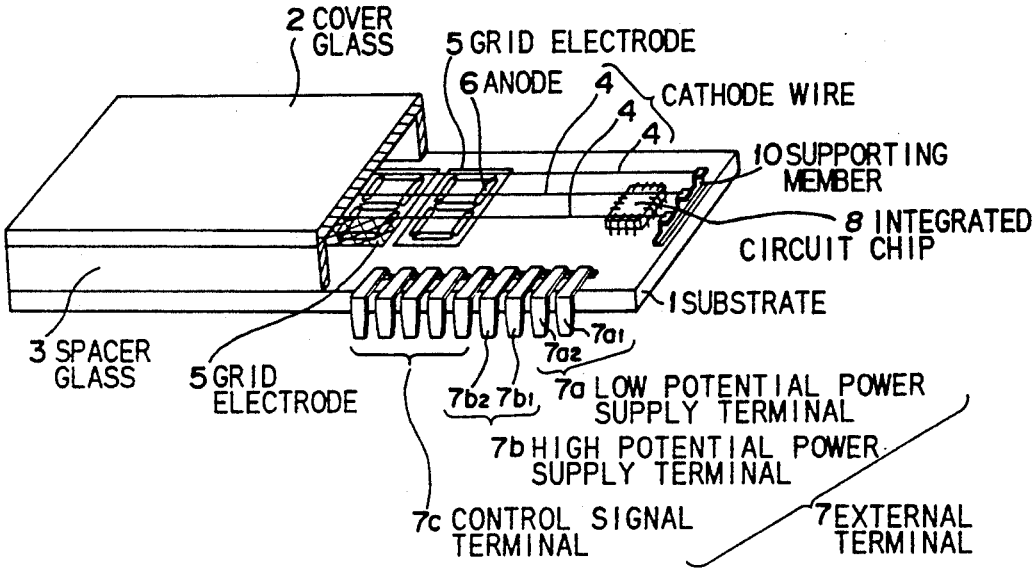
FIG. 3 is a partially cutaway view in perspective illustrating the vacuum fluorescent display device in a first preferred embodiment according to the invention.
Figure 4:
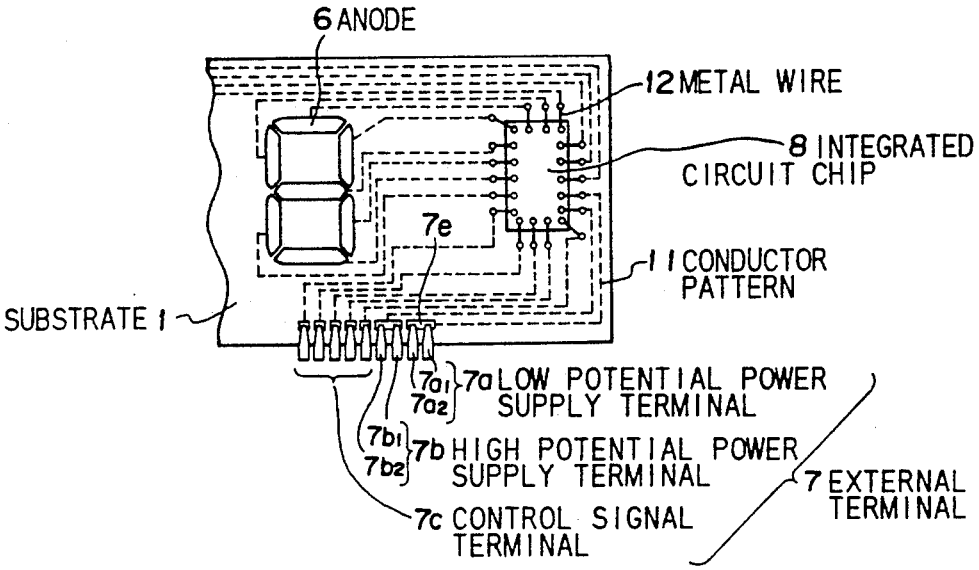
FIG. 4 is a segmental view illustrating the vacuum fluorescent display device in the first preferred embodiment according to the invention.

Next, FIGS. 3 and 4 show a VFD device in the first preferred embodiment according to the invention.

The VFD device comprises a substrate 1, on which a display unit for displaying predetermined patterns and an integrated circuit chip 8 for driving the display unit are mounted. The display unit comprises anodes 6 coated with fluorescent material, grid electrodes 5 disposed at positions which are above the anodes 6 with a proper spacing therebetween, and cathode wires 4 stretched above the grid electrodes 5 at a proper spacing. The end of the cathode wires 4 are welded on supporting members 10. The integrated circuit chip 8 is connected at pads thereof with metal wires 12, by which the integrated circuit chip 8 is supplied with an electric power or signals from external circuits outside the VFD device, or by which the integrated circuit chip 8 supplies the display unit with driving signals. External terminals 7 disposed on the edge of the substrate 1 are connected through the metal wires 12 and conductor patterns 11 which are disposed on the substrate 1 to the pads of the integrated circuit chip 8. The conductor patterns 11 also connect the pads of the integrated circuit chip 8 to the anodes 6 to supply the anodes 6 with driving signals from the integrated circuit chip 8. The integrated circuit chip 8 has two inputs for an electric power supply, one of which for low potential power supply, and other for high potential power supply. The external terminals 7*a* and 7*b* for supplying the integrated circuit chip 8 with an electric power comprise two parallel terminals $7a_1$ and $7a_2$, and $7b_1$ and $7b_2$, respectively, connected with each corresponding single conductor pattern connected to the integrated circuit chip 8. A cover glass 2 covers the above described elements on the substrate 1 with spacer glasses 3, wherein the glasses 2 and 3, and the substrate 1 are sealed with low melting point glass, so that a vacuum envelope of the VFD device is composed.

In operation, a voltage is applied to the cathode wires 4 to be heated. On the other hand, a predetermined voltage is applied to the grid electrodes 5 selectively by the integrated circuit 8. When the potential of the grid electrodes 5 becomes positive relative to that of the cathode wires 4, thermoelectrons are emitted from the cathode wires 4 toward the grid electrodes 5, and pass through the grid electrodes 5 to collide with the anodes 6 which are covered with fluorescent material, so that the fluorescence occurs on the surface of the anodes 6 to display a predetermined pattern according to the driving pattern of the grid electrodes 5.

As mentioned above, the external terminals 7*a* and 7*b* for supplying the integrated circuit chip 8 with an electric power comprise two parallel terminals $7a_1$ and $7a_2$, and $7b_1$ and $7b_2$, so that resistances of the terminals themselves, and those of the contact points 7*e* between the terminals and conductor patterns 11 becomes low. As a result, the potential change in the pads of the integrated circuit chip 8 which causes unstableness in operation of the integrated circuit chip and changes of characteristics thereof, is negligible.

Figure 5:
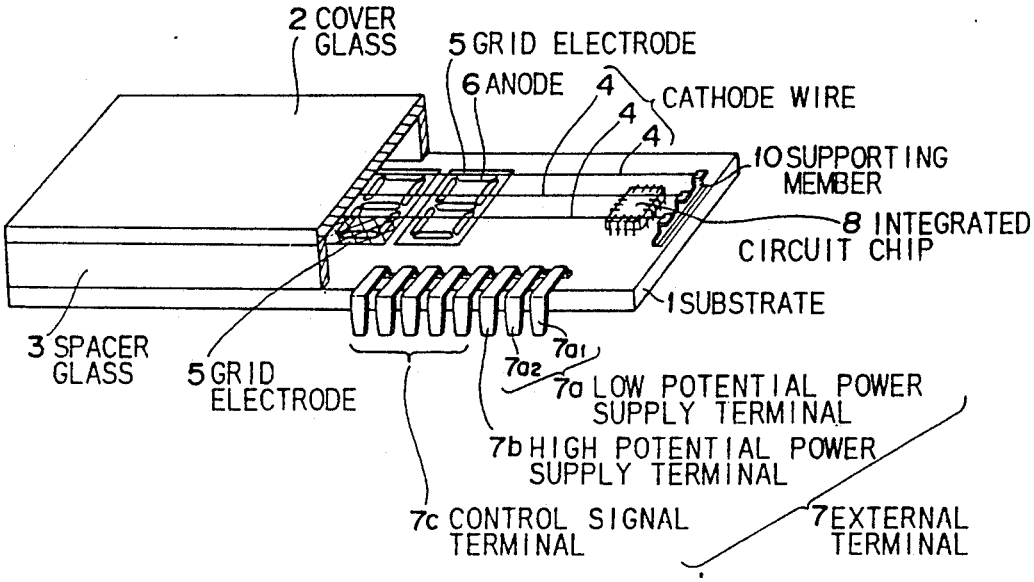
FIG. 5 is a partially cutaway view in perspective illustrating the vacuum fluorescent display device in a second preferred embodiment according to the invention.
Figure 6:
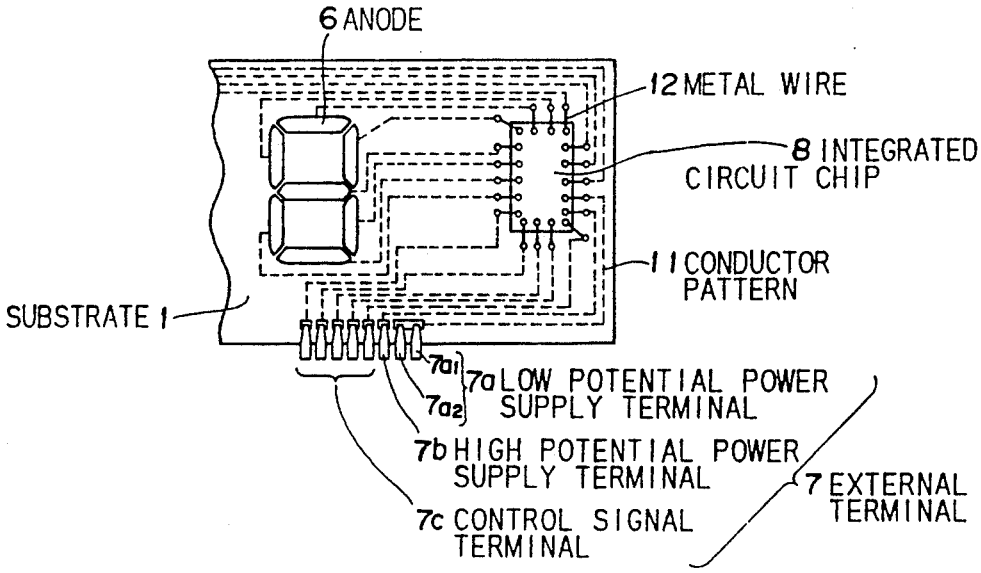
FIG. 6 is a segmental view illustrating the vacuum fluorescent display device in the second preferred embodiment according to the invention.

FIGS. 5 and 6 show a VFD device in the second preferred embodiment according to the invention, wherein like parts are indicated by like reference numerals as used in FIGS. 1 and 2. In the second preferred embodiment, though a basic structure of the device is the same as one explained in the first preferred embodiment, only external terminals 7*a* for low potential power supply consists of two parallel terminals $7a_1$ and $7a_2$, on the other hand, an external terminal 7*b* for high potential power supply consists of a single terminal like other control signal terminals 7*c*. The operation of the device is the same as one explained in the first preferred embodiment, therefore the operation thereof is not explained here.

Figure 7:
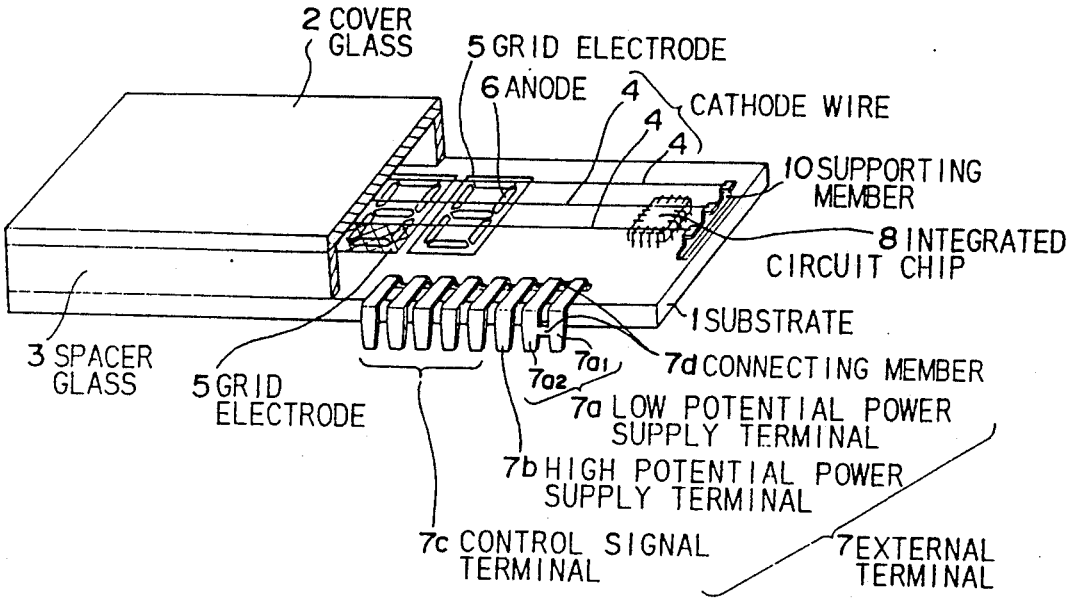
FIG. 7 is a partially cutaway view in perspective illustrating the vacuum fluorescent display device in a third preferred embodiment according to the invention.

FIG. 7 shows a VFD device in the third preferred embodiment according to the invention, wherein like parts are indicated by like reference numerals as used in FIG. 1. In the third preferred embodiment, though a basic structure of the device is the same as one explained in the first preferred embodiment, an external terminal 7*a* for low potential power supply consists of parallel terminals $7a_1$ and $7a_2$ combined by a connecting member 7*d*, or the external terminals $7a_1$, $7a_2$ and 7*d* may be integral by a single material. The operation of the device is the same as one explained in the first preferred embodiment, therefore the operation thereof is not explained here.

Although the invention has been described with respect to specific embodiment for complete and clear disclosure, the appended claims are not to be thus limited but are to be construed as embodying all modification and alternative constructions that may occur to one skilled in the art which fairly fall within the basic teaching herein set forth.

What is claimed is:

1. A vacuum fluorescent display device, comprising:

a substrate having conductive patterns disposed thereon;

a display unit for displaying predetermined patterns, said display unit being mounted on said substrate, said display unit including anodes coated with fluorescent material, grid electrodes disposed at positions which are above said anodes with a spacing therebetween, and cathode wires stretched above said grid electrodes with a spacing therebetween;

a driving circuit for driving said display unit, said driving circuit being an integrated circuit mounted on said substrate and being coupled to the conductive patterns;

at least one external terminal, connected to the conductive patterns to which said driving circuit is coupled, to be supplied with electric power from an external power supply, said at least one external terminal having at least two terminals, including a first terminal for low potential power supply, and a second terminal for high potential power supply, at least one of said first and second terminals including at least two parallel terminals electrically connected together, wherein the parallel terminals are connected to the integrated circuit by no more than one conductor; and a vacuum envelope which seals said display unit and driving circuit on said substrate.

2. The assembly of claim 1 wherein the at least two parallel terminals extend from an outer edge of the substrate for reducing resistances of the at least one external terminal.

3. A vacuum fluorescent display device, comprising:

a display unit for displaying predetermined patterns, said display unit being mounted on a substrate and including anodes coated with fluorescent material, grid electrodes disposed above said anodes with a predetermined spacing therefrom, and cathode wires stretched above said grid electrodes with a predetermined spacing therefrom;

a driving circuit for said display unit, said driving circuit being an integrated circuit mounted on said substrate; and an external terminal for supplying external electric power to said driving circuit, said external terminal being connected to said driving circuit by a conductive pattern disposed on said substrate, wherein said external terminal includes parallel terminals jointly connected to said conductive pattern, said parallel terminals being bridged by a connecting member and wherein the parallel terminals are connected to the integrated circuit by no more than one conductor.

4. The assembly of claim 3 wherein the parallel terminals extend from an outer edge of the substrate for reducing resistances of the external terminal.

5. An assembly comprising:

a first and second metal wire;

a substrate having a first and a second conductive pattern disposed thereon;

an integrated circuit, mounted on the substrate, having a single high potential power supply lead connected to the first conductive pattern by the first metal wire, and having a single low potential power supply lead connected to the second conductive pattern by the second metal wire;

external terminals for supplying external electric power to the integrated circuit, including a high potential power supply terminal having first parallel terminals bridged by a first connecting member, the first parallel terminals being jointly connected to the first conductive pattern, and a low potential power supply terminal having second parallel terminals bridged by a second connecting member, the second parallel terminals being jointly connected to the second conductive pattern.

6. The assembly of claim 5 wherein the first connective pattern has no more than one conductor connecting the first parallel terminals to the integrated circuit and the second conductive pattern has not more than one conductor connecting the second parallel terminals to the integrated circuits.

7. The assembly of claim 6 wherein the second connecting member bridges the second parallel terminals so that the second parallel terminals are integral.

8. The assembly of claim 5 wherein the first and second parallel terminals extend from an outer edge of the substrate for reducing resistances of the high potential power supply terminal and the low potential power supply terminal.

* * * * *